United States Patent [19]

Elsener

[11] Patent Number: 4,742,695

[45] Date of Patent: May 10, 1988

[54] BROOCH

[76] Inventor: Carl Elsener, Uetlibergstrasse 60, CH-8902 Urdorf, Switzerland

[21] Appl. No.: 824,185

[22] Filed: Jan. 30, 1986

[30] Foreign Application Priority Data

Feb. 14, 1985 [CH] Switzerland ..... 676/85

[51] Int. Cl.[4] ..... A44C 1/00; A44C 15/00

[52] U.S. Cl. ..... 63/1.1; 63/20; 24/160

[58] Field of Search ..... 24/157, 160; 63/20, 63/12; 40/1.5

[56] References Cited

U.S. PATENT DOCUMENTS

| | | | |
|---|---|---|---|
| 87,072 | 2/1869 | Rowland | 63/20 |
| 594,532 | 11/1897 | Hatten | 24/160 |
| 3,524,230 | 8/1970 | Hankel | 24/157 R |

FOREIGN PATENT DOCUMENTS

| | | | |
|---|---|---|---|
| 32958 | 5/1908 | Austria | 24/160 |
| 62673 | 12/1913 | Austria | 24/157 R |
| 3028470 | 3/1982 | Fed. Rep. of Germany . | |
| 3434475 | 11/1985 | Fed. Rep. of Germany | 63/12 |

*Primary Examiner*—Richard J. Johnson

*Attorney, Agent, or Firm*—Thomas W. Speckman; Ann W. Speckman

[57] ABSTRACT

A brooch comprising two parts (1, 2) is provided with a hinge (4) and a hinge pin (3). Pocket-like cavities (5, 6) are provided in the brooch parts (1, 2) diametrically opposite the hinge (4). A spring pin (7) is soldered in one of the pockets (5) which locks positively in the pocket in the other part of the brooch when it is closed. A pin (10) is affixed to one part of the brooch and extends across the brooch from an area remote from the hinge to an area adjacent the hinge on the other part of the brooch (2) where an eye (11) is provided. As the two parts (1, 2) of the brooch are swung open or shut, the tip of the pin (10) moves into or out of the eye (11). A notch (12) is provided at the joint between the two parts of the brooch (1, 2). The fastener according to the present invention is particularly compact, hardly increases the thickness of the piece of jewelry concerned and makes possible the creation of a number of new designs of jewelry.

5 Claims, 3 Drawing Sheets

BROOCH

BACKGROUND OF THE INVENTION

The type of fastener usually employed for a brooch resembles a safety pin. A hinge is provided at the rear of the brooch which serves as a support for the pin. The tip of the pin is retained in a safety device located opposite the hinge. The most common type of safety devices are the sliding fastener and the ball type safety fastener. The sliding fastener consists essentially of a sleeve provided with a lateral slot into which the pin is inserted and which is then closed by means of a spring-loaded slide. The ball type safety fastener differs from the sliding fastener principally in respect to its spherical shape. The slide is curved to match the spherical shape of the fastener and bridges a notch into which the pin is inserted.

A fastener for a brooch is known from Austrian Patent AT-PS No. 62 673 in which the tip of the pin is retained in a safety fastening which can be rotated and fixed in position. An integral feature of the design of safety fasteners of this type is the relatively large distance between the pin and the brooch. As a result, the brooch tends to rotate about the pin.

A design of costume jewelry consisting of a plastic pearl worn as a decorative hair clip is known from German Patent Document DE-A No. 30 28 470. The pearl is provided with a continuous opening and its two halves can be swung open about a fine hinge. In one embodiment, pins which project inward are located in the continuous opening. A fastener of this type is utterly unsuitable for use with a brooch.

SUMMARY OF THE INVENTION

A purpose of the present invention is to provide a fastener for a brooch which allows the brooch to be fastened closer to the wearer and which provides enhanced safety in that it is less likely to open inadvertently; a further purpose is to provide a design of fastener which is easily manipulated.

These objectives are attained by a design of fastener for a brooch wherein the brooch comprises two parts connected to one another by means of a hinge, each of the two parts having complementary fastening elements located diametrically opposite the hinge for fastening the two parts together, and a pin affixed to one part of the brooch near the fastening elements and extending across the brooch and engaging in an eye fastened to the other part of the brooch near the hinge when the brooch is closed.

BRIEF DESCRIPTION OF THE DRAWINGS

One embodiment of the fastener according to the present invention is shown in the attached drawings which illustrate a number of brooches provided with this design of fastener, in which.

DESCRIPTION OF PREFERRED EMBODIMENTS

Figure 1:
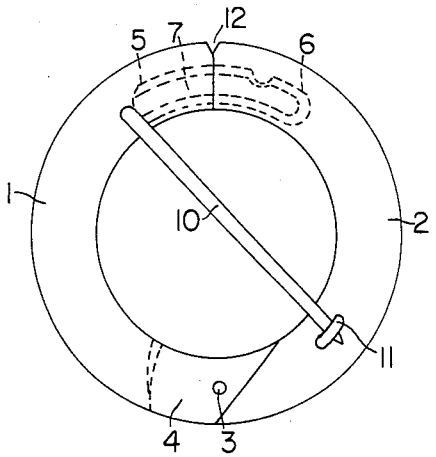
FIG. 1 shows a brooch provided with a fastener according to the present invention, wherein the fastener is closed and seen from the rear.

Unlike previous types of brooches, the brooch of annular shape shown here comprises two parts which are connected to one another and can be swung apart. Two parts 1 and 2, which comprise half rings in this instance, are connected to one another by means of hinge pin 3. The design of hinge 4 is unimportant in this instance but it is essential for the hinge to provide a means of precise guidance of the two hinged parts 1 and 2. Fastening elements are provided in each of the two parts of the brooch, and the fastening elements are located diametrically opposite hinge 4, when the brooch is closed. Each part of the fastener is provided with a pocket-like cavity 5, 6 adjacent to the fastening area. Spring pin 7 is retained in pocket 5 of part 1 of the fastener. The diameter of spring pin 7 is somewhat less than the diameter of pocket 5. Spring pin 7 is curved like the two pockets 5 and 6. The end of spring pin 7 projecting beyond pocket 5 is provided with notched recess 8. When the fastener is closed, cam 9 engages in this recess 8, whereby the cam projects into pocket 6 of part 2 of the brooch. The diameter of pocket 6 is such as to allow the spring pin to slide over cam 9 without sticking in the pocket.

A pin extends from an area near the rear end of spring pin 7 across the brooch as far as an area adjacent to hinge 4 on the other part 2 of the brooch. Eye 11 is soldered to part 2 of the brooch adjacent to hinge 4. As part 2 of the brooch is swung shut, eye 11 is located over the tip of pin 10.

Figure 2:
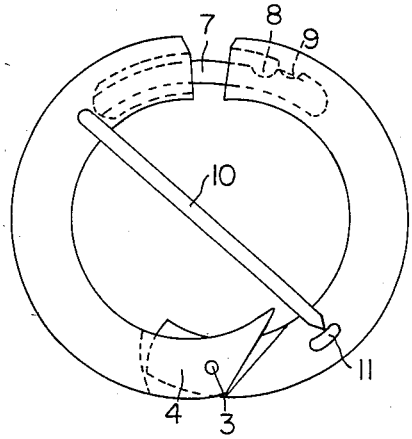
FIG. 2 shows the brooch of FIG. 1 with the fastener half open.
Figure 3:
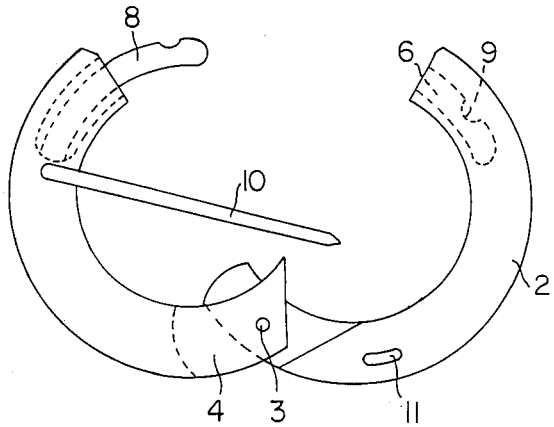
FIG. 3 shows the broochof FIG. 1 with the fastener completely open.
Figure 10:
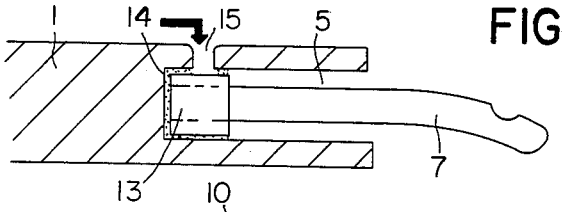
FIGS. 10 and 11 show two stages in the assembly of one part of the fastener.
Figure 11:
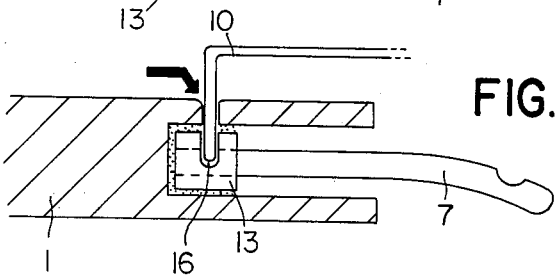

To open the fastener, the user inserts her nail in notch 12 at the joint between the two parts 1 and 2. This has the effect of causing the two parts to pivot by a very slight amount relative to one another about hinge pin 3, whereby spring pin 7 together with its recess 8 slides past the cam retainer 9. This position is illustrated in FIG. 2. Pin 10 is withdrawn from eye 11, as can be clearly seen in the drawing. If both parts 1 and 2 of the brooch are further separated, eye 11 is moved far enough away from pin 10 so that it no longer obstructs insertion of the pin into a garment (FIG. 3). This design of fastener is especially suitable for jewelry produced in high volume. The assembly of the fastener is briefly described in FIGS. 10 and 11. The spring pin 7 is inserted in pocket 5 of the mass-produced part 1 of the brooch. The diameter of spring pin 7 is considerably less than that of pocket 5 of part 1 of the brooch. To allow the spring pin to be retained in pocket 5, it is provided with a fitted metal collar 13. Solder 14 is introduced through a radial bore 15 which opens into pocket 5. A pocket 16 is then bored through radial bore 15 and through spring pin 7 and cuff 13. Pin 10 is then inserted as far as the end of pocket 16 and is soldered in place.

Figure 4:
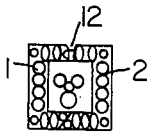
FIGS. 4–9 show various embodiments of brooches provided with fasteners according to the present invention.
Figure 5:
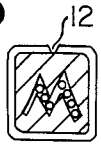
Figure 6:
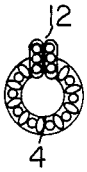
Figure 7:
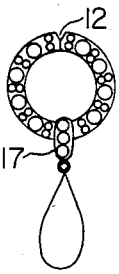
Figure 8:
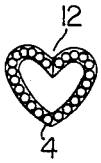
Figure 9:
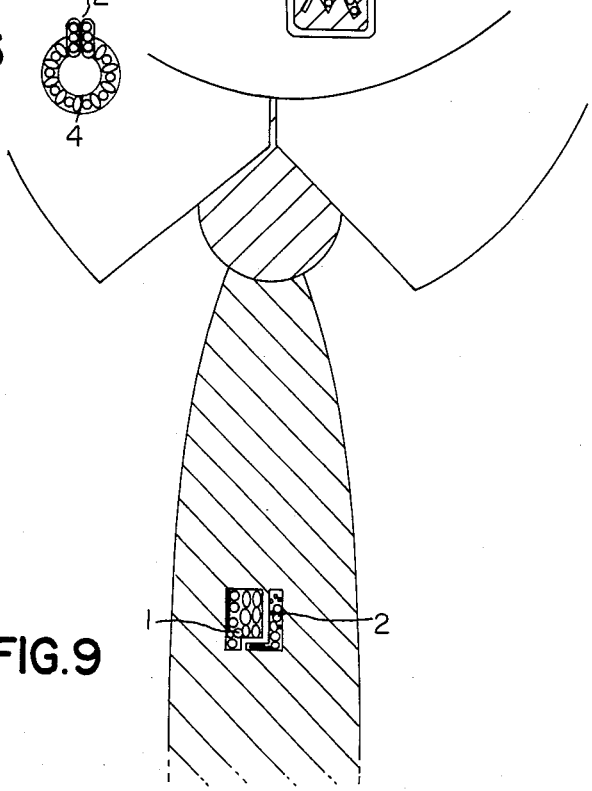

This new type of brooch fastener makes new designs of brooches possible. Some examples of such designs are shown in FIGS. 4–9, which are however by no means limitative. Open, generally ring-shaped jewelry is shown in FIGS. 6, 7 and 8. When the fastener according to the present invention is worn, little more than notch 12 and, seen from close up, hinge 4 are visible. In the embodiment shown in FIG. 7, the hinge is further hidden by means of pendant 17. Jewelry with a closed surface is shown in FIGS. 4, 5 and 9. The joint between the two parts 1 and 2 of the brooch may be hardly visible, or it may take the form of a decorative element, as shown in FIG. 9, where it forms an integral part of the design.

One of the important advantages of the fastener according to the present design lies in the fact that the actual components of the fastener are simple, sturdy and safe. It is almost inconceivable for the brooch to fall open accidentally. Furthermore, this design provides the jeweler with many opportunities for creating brooches of a new design. Moreover, the danger of the user wounding herself with this design is considerably reduced as the pin is more or less parallel to the piece of jewelry and hardly projects beyond it.

Figure 12:
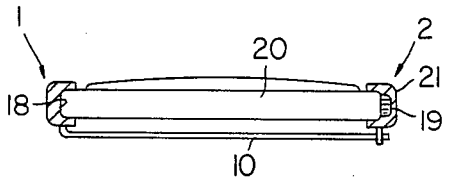
FIGS. 12–14 show a brooch in the form of a watch.
Figure 13:
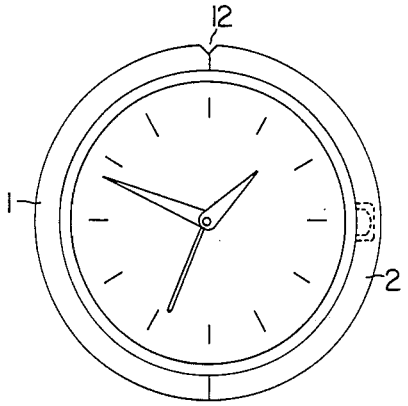
Figure 14:
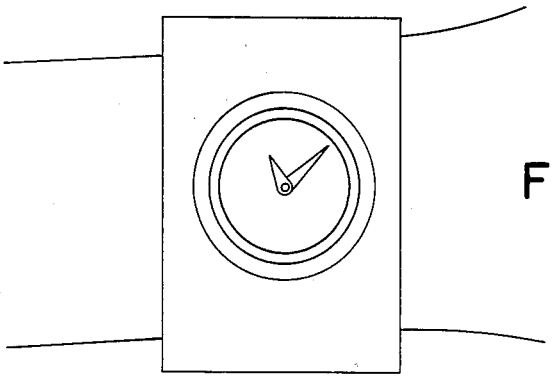

The fastener according to the present invention is also suitable as a mounting for a watch in the form of a piece of jewelry, as shown in FIGS. 12–14. In this case, the two parts 1 and 2 of the brooch will be semicircular in shape and are provided with an annular groove 18 facing inwards. Recess 21 is provided in part 2 of the brooch adjacent to winding element 19 of watch 20. If an inexpensive plastic watch is used, the brooch parts 1 and 2 may usefully be made of plastic as well, whereby the watch is permanently bonded or welded in a plastic part 1 and only part 2 of the brooch can move freely. This latter design provides a fashionable accessory which can be worn on top of cuffs or other textile accessories or garments.

I claim:

1. A brooch comprising two separable parts (1,2) aligned in a common plane and connected by a hinge (4), the rotational axis (3) of said hinge being arranged perpendicular to the plane of said brooch, said two parts being provided with fastening elements (5–9) arranged diametrically opposite said hinge, a pin (10) rigidly attached to the back of one of said parts of said brooch adjacent to said fastening elements and extending across the back of said brooch, and an eye (11) rigidly attached on the back of the other of said parts of said brooch adjacent said hinge and approximately diametrically opposite the attachment point of said pin, whereby said two parts of said brooch are positively locked by engagement of said fastening elements and said pin is engaged in said eye when said two parts of said brooch are rotated toward one another, and said fastening elements are disengaged and said pin is disengaged from said eye when said two parts of said brooch are rotated away from one another.

2. A brooch according to claim 1, characterized in that said pin (10) is parallel to the plane of said brooch and displaced a distance therefrom equalling the thickness of a garment.

3. A brooch according to claim 1, characterized in that a notch (12) marks the joint between said two parts of said brooch in said closed position, and said notch is arranged in an area diametrically opposite said hinge (4).

4. A brooch according to claim 1, characterized in that both said parts of said brooch are semicircular in shape and are provided with a groove facing inwards in which a watch can be accommodated, and one of said two parts is provided with a recess retaining a winding element of said watch.

5. A brooch according to claim 4, characterized in that both said parts of said brooch comprise plastic material.

* * * * *